United States Patent [19]

Brandon, Jr. et al.

[11] 4,362,774

[45] Dec. 7, 1982

[54] DRAPERY FABRIC FOAM BACKING

[75] Inventors: William A. Brandon, Jr.; William D. Bailey, both of Burlington, N.C.

[73] Assignee: Burlington Industries, Inc., Greensboro, N.C.

[21] Appl. No.: 274,200

[22] Filed: Jun. 16, 1981

Related U.S. Application Data

[63] Continuation of Ser. No. 107,636, Dec. 27, 1979, abandoned.

[51] Int. Cl.[3] ..... B05D 1/14; B05D 1/16; B05D 3/10; B32B 5/18

[52] U.S. Cl. ..... 428/159; 427/198; 427/206; 427/271; 427/273; 428/159; 428/90; 428/311.1; 427/342

[58] Field of Search ..... 428/90, 158, 159, 310, 428/311; 427/198, 200, 206, 264, 271, 273, 359, 428, 342

[56] References Cited

U.S. PATENT DOCUMENTS

| | | | |
|---|---|---|---|
| T896,018 | 3/1972 | Taub | 428/246 |
| 3,098,755 | 7/1963 | Barth et al. | 428/90 |
| 3,149,994 | 9/1964 | Congleton et al. | 427/264 |
| 3,281,258 | 10/1966 | Callahan | 427/273 X |
| 3,527,654 | 9/1970 | Jones et al. | 117/66 |
| 3,528,874 | 9/1970 | Spencer | 428/89 |
| 3,607,341 | 9/1971 | Goins | 117/10 |
| 3,978,855 | 9/1976 | McRae et al. | 428/311 X |
| 4,016,831 | 4/1977 | James et al. | 118/415 |
| 4,056,646 | 11/1977 | Westfall et al. | 428/90 |
| 4,198,448 | 4/1980 | Kauffman et al. | 427/264 |

FOREIGN PATENT DOCUMENTS

| | | | |
|---|---|---|---|
| 743571 | 12/1969 | Belgium . | |
| 48-2712 | 1/1973 | Japan | 427/200 |
| 2019251 | 2/1978 | United Kingdom . | |

*Primary Examiner*—Shrive P. Beck
*Attorney, Agent, or Firm*—Cushman, Darby & Cushman

[57] ABSTRACT

A method of making a foam backed drapery fabric or the like having good textile properties, and the fabric so produced. A wet foam backing is applied to a moving web of fabric, flocking is optionally applied to the wet foam backing, and the backing is at least partially dried without significant curing. The backing is then embossed with a patterned roller, and an aqueous solution containing a release agent and a wetting agent is kiss-coated to the foam backing to penetrate the foam backing without substantial penetration of the fabric, the aqueous solution being applied at about 50 to 80% pickup on dried foam solids weight. Where a curing oven containing rollers is utilized the foam backing is then dried, and then passed to the curing oven. The final fabric has good textile-like feel, softness, drape, abrasion resistance, and appearance characteristics, and the embossed backing is capable of recovering in five seconds to one minute after 3,000 psi has been applied for five minutes.

11 Claims, 2 Drawing Figures

DRAPERY FABRIC FOAM BACKING

This is a continuation of application Ser. No. 107,636, filed Dec. 27, 1979, now abandoned.

BACKGROUND AND SUMMARY OF THE INVENTION

The invention relates to a method of making a foam backed drapery fabric or the like, and the fabric so produced. Foam backed fabrics have found many uses, especially for draperies. Foam backed drapery fabrics provide all of the light-blocking properties of conventional lined draperies at a fraction of the cost.

Conventionally, in the production of foam backed drapery fabrics, it is necessary to crush the foam after it is applied, and then to cure it. Without crushing, the foam backing does not have the necessary abrasion resistance properties to be useful as a drapery fabric. While conventional foamed drapery fabrics are generally suitable, they do not have optimum textile-like feel, drape, or appearance characteristics. It is known that embossing can improve the textile-like properties of foam backing (see U.S. Pat. No. 3,527,654), however embossing has not normally been utilized in the construction of foam backed drapery fabrics. Also, there has been an inability to properly set the embossed pattern so that it will last the lifetime of the fabric, and will impart textile-like properties desired.

According to the present invention, a method of producing embossed foam backed drapery fabrics or the like, and the fabrics so produced, are provided that overcome the problems inherent in the prior art. According to the present invention the embossed impression in the foam backing is properly set and attains permanency so that it imparts optimum desirable textile-like characteristics to the final fabric. The embossed foam backed drapery fabric has a more textile-like texture than merely crushed foam backed fabrics, and the embossed foam backed fabric has improved softness, drape, and appearance characteristics.

According to one aspect of the method according to the present invention, a foam backed drapery fabric or the like is made from a moving web of material. A wet foam backing is applied to the moving web of fabric, the foam backing is at least partially dried without significantly curing it, and the foam backing is embossed. Then an aqueous solution containing a release agent and a wetting agent is applied to the foam backing to substantially penetrate the foam backing without substantial penetration of the fabric web. The foam backing is then cured to produce a final drapery fabric or the like having good feel, abrasion resistance, drape, and appearance characteristics.

According to another aspect of the method according to the present invention, a foam backed drapery fabric or the like is made from a moving web of fabric by substantially sequentially applying a wet cross-linking foam backing to the moving web of fabric; at least partially drying, without significantly curing, the wet foam backing; and embossing the foam backing. Then a predetermined sufficient amount of moisture containing a release agent and a wetting agent is returned to the embossed foam backing so that the cross-linking of the foam backing may proceed to completion and thereby fix the embossing, but so that collapse of the foam cell structure does not occur, and then the backing is cured.

According to yet another aspect of the method according to the present invention, a foam backed drapery fabric or the like is produced from a moving web of fabric by practicing the steps consisting essentially of: Applying a wet foam backing to the moving web of fabric. Applying a flock to the wet foam backing. At least partially drying, without significantly curing, the foam backing. Embossing the foam backing. Applying an aqueous solution at about 50 to 80% pickup on dry foam solids weight to the foam backing, without substantial penetration of the fabric. Drying the foam backing; and curing the foam backing to produce a final drapery fabric or the like having good textile properties.

The aqueous solution has a release agent and a wetting agent, and preferably also includes a curing catalyst, and preferably is applied to the foam backing by kiss-coating, although it also may be sprayed.

The final drapery fabric or the like produced according to the present invention has an embossed foam backing capable of recovering in five seconds to one minute after 3,000 psi has been applied thereto for five minutes. The drapery fabric has improved softness, textile-like feel, drape, and appearance characteristics compared to conventional foam backed drapery fabrics.

It is the primary object of the present invention to provide a foam backed drapery fabric or the like having improved textile properties. This and other objects of the invention will become clear from an inspection of the detailed description of the invention and from the appended claims.

DETAILED DESCRIPTION OF THE INVENTION

Figure 1:
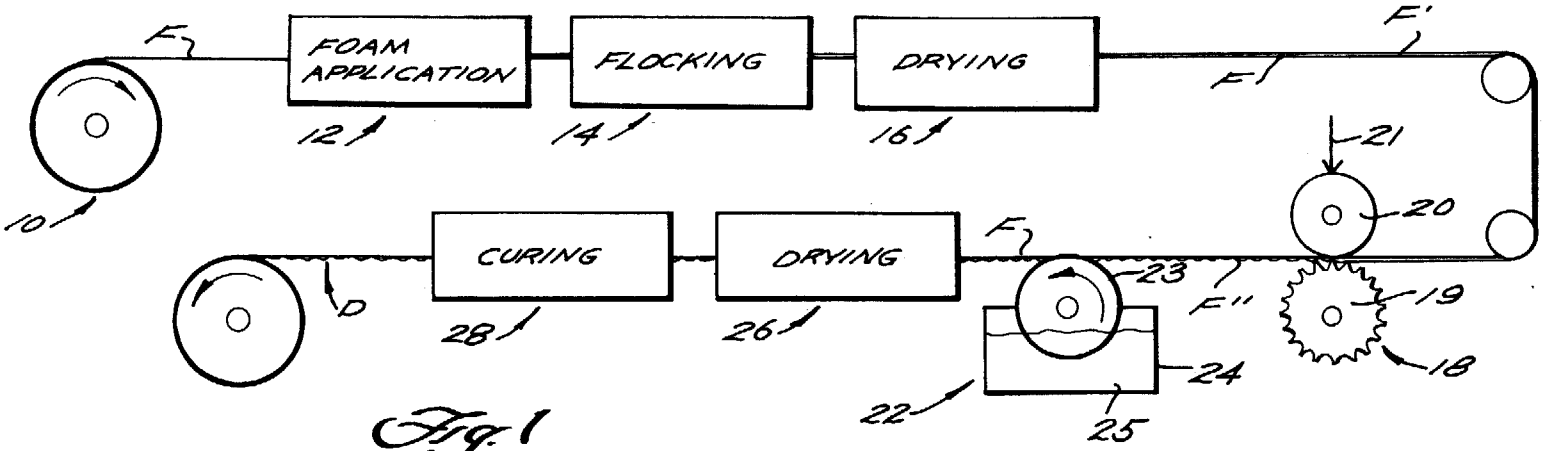
FIG. 1 is a schematic view illustrating a sequence of steps for practicing an exemplary method according to the present invention.

An exemplary method of producing a foam backed drapery fabric or the like from a moving web of fabric F is readily seen by an inspection of FIG. 1. The web of fabric F is supplied from a source 10 to a foam application station 12 wherein a wet foam backing is applied to the moving web. The foam backing may be applied by coating or other conventional techniques, and preferably is applied by defining a fluid-foam pillow, passing the fabric web F past the foam pillow, and allowing only a portion of the foam in the foam pillow to pass with the web as it moves past the pillow. Such an arrangement is more fully described in U.S. Pat. No. 4,016,831, the disclosure of which is hereby incorporated by reference herein. The foam is any cross-linking suitable foam, either self cross-linking, or including a textile resin for cross-linking, or both, with self-cross-linking acrylic latex foams plus textile resin being preferred.

After application of foam F' to the top of the fabric web F it passes to a flocking station 14. The flocking station 14 is conventional, and preferably comprises a mechanical flocking module, with short fiber cotton flocking preferred. The flocking improves the textile-like feel properties of the final fabric produced.

After flocking, the web F then passes to a drying station 16 at which the foam backing F′ is at least partially dried, without significant curing thereof. The drying station 16 may be a conventional tenter dryer, and preferably drying is practiced so that the foam surface exit temperature from the drying station 16 is about 200°-240° F.

The fabric web F with the dried foam backing F′ then proceeds immdiately to an embossing station 18. The foam backing is embossed to provide crushing thereof to thereby increase the abrasion resistance of the foam backing. In addition to crushing the foam backing, embossing makes the final fabric produced softer, provides a more textile-like texture than mere crushing, and enhances the appearance, in general resulting in an improved final fabric. The embossing station 18 may include any conventional means, preferably including an embossing steel roller 19, having a suitable pattern formed on the face thereof (e.g. 1/12-inch screen wire pattern) with a rubber roller 20 acting against the fabric web. A force sufficient to effect embossing (e.g. 8 tons) is applied to the rubber roller, as indicated by arrow 21 in FIG. 1.

Figure 2:
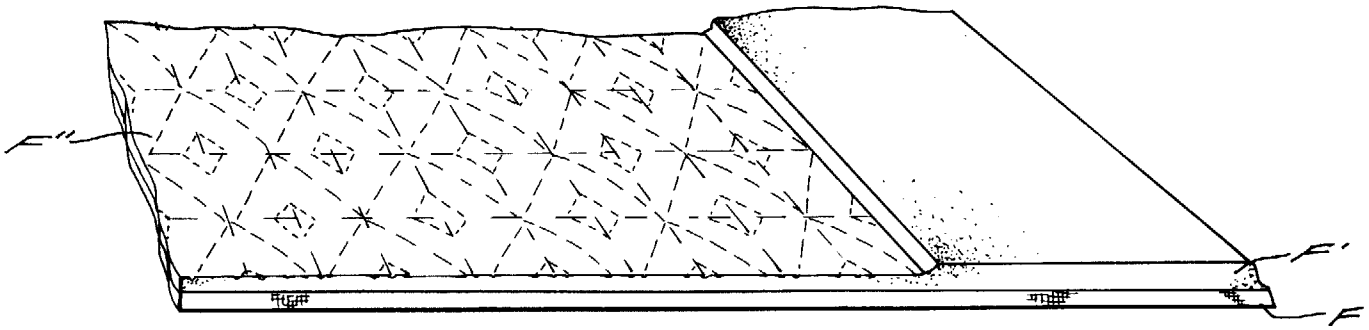
FIG. 2 is a perspective view of a portion of a foam backed drapery fabric or the like produced according to the present invention with the rightmost portion of the foam backing being uncrushed, and the leftmost portion thereof being embossed.

FIG. 2 illustrates the foam backed fabric web according to the present invention, the fabric itself being indicated at F, the foam backing before embossing (crushing) being illustrated at F′, and the embossed foam backing being illustrated at F″. The right side of FIG. 2 illustrates the web before it passes to the embossing station 18, and the left side the web after it passes through the embossing station 18.

In order to impart permanency to the embossed pattern, according to the present invention the embossed foam backed web F″ is next immediately passed to an aqueous solution application state 22. An aqueous solution containing a suitable release agent (e.g. silicone emulsion softener), a suitable wetting agent, and preferably a curing catalyst (e.g. acid catalyst) is applied here. The release agent prevents foam interstices not already crushed from sticking together, the wetting agent ensures penetration of the solution substantially through the entire foam backing, and the catalyst speeds up the cure during subsequent processing. Enough solution is applied to penetrate the foam backing without substantial penetration of the fabric web, but care is taken not to apply too much solution since too much solution would collapse the foam cell structure. A 50 to 80% pickup on dry foam solids weight of solution has been found to effect the results desired according to the present invention (comparable to about 18 to 25% pickup based on weight of fabric and foam, with 20% being optimum). While the exact theory explaining why the application of the aqueous solution effects proper setting of the embossed pattern is not known, it is believed that the aqueous solution provides a sufficient amount of moisture to the dry foam backing so that the necessary cross-linking chemical reactions in the foam backing may proceed to completion, thereby fixing the embossing.

The aqueous solution application step may be accomplished by spraying the aqueous solution onto the foam backing, although application of the aqueous solution by kiss-coating is preferred. As illustrated in FIG. 1, a roller 23 rotates in a tank 24 having the aqueous solution 25 therein, the speed of rotation of the roller 23 determining the amount of solution applied to the foam backing.

After the aqueous solution application station 22, the foam backed web is ultimately passed to a curing station 28. However, where the apparatus utilized in the curing station comprises rollers in a curing oven, over which rollers the web passes, it is necessary to provide a predrying station 26, otherwise the rollers in the curing oven will have a tendency to iron out the embossed pattern. The drying station 26 preferably comprises an electric quartz infra-red predrier, and the curing station 28 then comprises a conventional curing oven with rollers or the like over which the web passes. After passing through the curing station 28, the final drapery fabric D or the like is provided.

Of course other conventional steps may be practiced on the final drapery fabric D. For instance it may be washed to remove excess flock or soften hand still further. The final drapery fabric D produced comprises an embossed foam backed fabric wherein the foam backing is capable of recovering in five seconds to one minute after the application of 3,000 psi thereto for five minutes. The final fabric has desirable textile-like feel, drape, abrasion resistance, and appearance characteristics and is eminently suited for use in the construction of draperies.

EXAMPLE

A woven drapery fabric F having a weight of 0.392 pounds per linear yard (45 inch width) made of 41% polyester, 58% rayon, and 1% acrylic fibers wascoated with foam by passing it past a foam pillow. 3.2 dry ounces per linear yard of foam was applied with a wet density of 170 grams per liter. The foam composition included an acrylic polymer, resin cross-linking agent, foaming agent, foam stabilizer, filler material, and pigment. After application of the wet foam the fabric entered a mechanical flocking module where about 0.5 ounces of short fiber cotton flock per linear yard were applied to the wet foam. The process speed during the entire treatment was about 40 yards per minute.

After passing through the mechanical flocker 14, the foam backed web passed to a tenter dryer 16, having a first drier section at 275° F. and second and third drier section at 320° F. each. The fabric exiting the drier had a foam surface temperature of about 230° F. The fabric then passed to an embossing station 18 wherein an embossing roller with a 1/12 inch screen wire pattern was brought into contact with the foam backing while a force 21 of 8 tons was applied to the rubber roller 20. The embossed foam backed fabric was then passed to the aqueous pickup station. The aqueous solution 25 included 1% silicone emulsion softener (60% active), 0.1% ethoxylated alcohol wetting agent, and 0.08% p-toluenesulfonic acid catalyst. The speed of rotation of the roller 23 was controlled relative to the process speed of the web so that the aqueous solution was applied at 60% pickup, which penetrated the foam backing without substantial penetration of the fabric. The web was then passed to an electric quartz infra-red predrier 26, and then to a conventional roller cure oven 140 yards long wherein the temperature was maintained at 320° F. The final fabric D produced had excellent textile-like feel, softness, drapeability, and appearance characteristics. When a force of 3,000 psi was applied for five minutes to the foam backing, the backing recovered in less than one minute.

It will thus be seen that according to the present invention an improved method of making a foam backed drapery fabric, and the fabric so produced have been provided, the backing having a permanent embossed pattern formed thereon which is capable of quick recovery, has high abrasion resistance, and improves the texture, softness, and textile-like appearance of the foam backing. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and products.

What is claimed is:

1. A drapery fabric having desirable textile properties and produced by applying a wet, cross-linking foam backing to the moving web of fabric; at least partially drying, without significantly curing, the wet foam backing; embossing the foam backing; applying an aqueous solution consisting essentially of water, a release agent, a curing catalyst, and a wetting agent to the foam backing at about 50–80% pickup on dry foam solids weight; and curing the wet foamed backing.

2. A method of making a foam-backed drapery fabric from a moving web of fabric, comprising the steps of sequentially (a) applying a wet, cross-linking foam backing to the moving web of fabric;

(b) at least partially drying, without significantly curing, the wet foam backing;

(c) embossing the foam backing;

(d) applying an aqueous solution free from resin to the foam backing at about 50–80% pickup on dry foam solids weight; and (e) curing the web foam backing to produce a final drapery fabric having desirable textile properties.

3. A method as recited in claim 2 wherein step (e) is accomplished in a curing oven having rollers over which the foam-backed web travels, and comprising the further step of (d1) drying the foam backing prior to passing it into the curing oven so that the embossing thereon will not be ironed out in the curing oven.

4. A method as recited in claim 2 comprising the further step of (a1) applying a flock to the wet foam backing.

5. A method of making a foam-backed drapery fabric from a moving web of fabric, consisting essentially of the steps of sequentially (a) applying a wet foam backing to the moving web of fabric;

(a1) applying a flock to the wet foam backing;

(b) at least partially drying, without significantly curing, the foam backing;

(c) embossing the foam backing;

(d) applying an aqueous solution free of resin at about 50–80% pickup on dry foam solids weight to the foam backing, without substantial penetration of the fabric;

(d1) drying the foam backing so that the embossing will not be ironed out; and (e) curing the foam backing to produce a final drapery fabric or the like having good textile properties.

6. A method as recited in claims 2 or 5 wherein step (a) is accomplished by defining a fluid-foam pillow, passing the fabric web past the foam pillow, and allowing only a portion of the foam in the foam pillow to pass with the web as it moves past the pillow.

7. A method as recited in claims 2 or 5 wherein step (c) is accomplished by passing the foam backing into contact with an embossing roller while embossing pressure is provided to the fabric web by a rubber roller having an axis of rotation parallel to that of the embossing roller.

8. A method as recited in claims 2 or 5 wherein step (d) is accomplished by applying to the foam backing an aqueous solution consisting essentially of water, a wetting agent, a release agent, and a curing catalyst.

9. A method as recited in claim 8 wherein step (b) is accomplished by passing the web through a drying oven so that the foam surface temperature of the exiting web is about 200–240° F.

10. A method as recited in claim 8 wherein all the steps are practiced so that the foam backing of the final drapery fabric produced recovers in 5 seconds to 1 minute after 3000 psi has been applied for 5 minutes.

11. A method as recited in claim 8 wherein step (d) is further accomplished by kiss-coating the foam backing.

* * * * *